US009038733B2

(12) United States Patent
Wijning et al.

(10) Patent No.: US 9,038,733 B2
(45) Date of Patent: May 26, 2015

(54) TUBULARS STORAGE AND HANDLING SYSTEM

(75) Inventors: Diederick Bernardus Wijning, Schiedam (NL); Joop Roodenburg, Delft (NL)

(73) Assignee: ITREC B.V., Schiedam (NL)

( * ) Notice: Subject to any disclaimer, the term of this patent is extended or adjusted under 35 U.S.C. 154(b) by 784 days.

(21) Appl. No.: 13/266,703

(22) PCT Filed: Apr. 15, 2010

(86) PCT No.: PCT/NL2010/000067

§ 371 (c)(1), (2), (4) Date: Jan. 12, 2012

(87) PCT Pub. No.: WO2010/126357

PCT Pub. Date: Nov. 4, 2010

(65) Prior Publication Data

US 2012/0103623 A1 May 3, 2012

Related U.S. Application Data

(60) Provisional application No. 61/173,732, filed on Apr. 29, 2009.

(51) Int. Cl.

| | |
|---|---|
| ***E21B 7/128*** | (2006.01) |
| ***E21B 7/12*** | (2006.01) |
| ***E21B 19/16*** | (2006.01) |
| ***E21B 19/14*** | (2006.01) |

(52) U.S. Cl.
CPC ..... *E21B 19/146* (2013.01)

(58) Field of Classification Search
CPC ..... E21B 19/143; E21B 19/146
USPC ..... 166/352, 358, 77.51; 175/52, 85; 414/22.51, 22.63, 22.66
See application file for complete search history.

(56) References Cited

U.S. PATENT DOCUMENTS

| | | | | | |
|---|---|---|---|---|---|
| 1,149,677 | A | * | 8/1915 | Parker | 414/266 |
| 1,684,008 | A | * | 9/1928 | Bouslog | 211/70.4 |
| 3,157,286 | A | * | 11/1964 | Gyongyosi | 211/1.53 |
| 3,185,310 | A | * | 5/1965 | Klem | 211/70.4 |
| 3,265,138 | A | * | 8/1966 | Alexander et al. | 175/52 |
| 3,286,777 | A | * | 11/1966 | Gyongyosi | 175/52 |

(Continued)

FOREIGN PATENT DOCUMENTS

WO WO 02/18742 A1 3/2002

*Primary Examiner* — Matthew Buck
*Assistant Examiner* — Edwin Toledo-Duran
(74) *Attorney, Agent, or Firm* — Birch, Stewart, Kolasch & Birch, LLP

(57) ABSTRACT

A hydrocarbon drilling tubulars storage and handling system, said system comprising: —first and second rotary storage racks, each rotary storage rack being rotatable about a vertical axis and having storage slots for storage of multiple tubulars in each rotary storage rack in vertical orientation, the first and second rotary storage rack each including a drive to rotate the storage rack about its vertical axis, —a tubulars racking device positioned between the first and second rotary storage racks, said racking device including a rotary structure that is rotatable about a vertical axis and a drive to rotate the rotary column structure about said vertical axis, the rotary structure supporting at a first side thereof a first tubular racker assembly and at a second side thereof a second tubular racker assembly, each tubular racker assembly including one or more one gripping members adapted to grip a tubular.

17 Claims, 4 Drawing Sheets

(56) References Cited

U.S. PATENT DOCUMENTS

Figure 1:
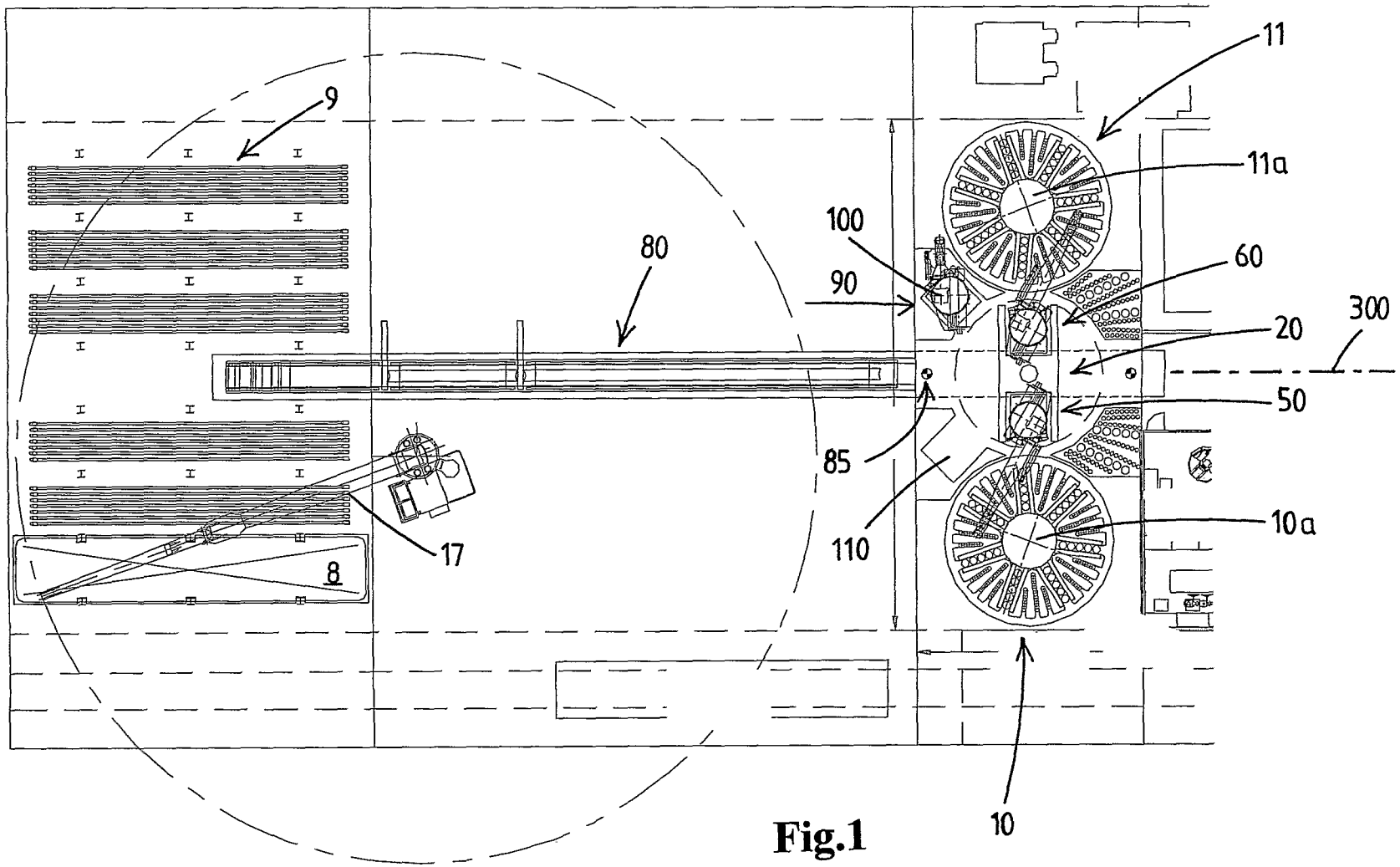

| | | | | | |
|---|---|---|---|---|---|
| 3,336,991 | A * | 8/1967 | Klem et al. | 175/85 |
| 3,493,061 | A * | 2/1970 | Gyongyosi | 175/52 |
| 3,680,412 | A * | 8/1972 | Mayer et al. | 81/57.34 |
| 3,734,212 | A * | 5/1973 | Perlewitz | 175/171 |
| 3,913,687 | A * | 10/1975 | Gyongyosi et al. | 175/85 |
| 3,913,753 | A * | 10/1975 | Swartz et al. | 414/22.66 |
| 3,913,754 | A * | 10/1975 | Swartz et al. | 414/22.66 |
| 3,966,053 | A * | 6/1976 | Loftis | 211/70.4 |
| 4,043,407 | A * | 8/1977 | Wilkins | 175/50 |
| 4,049,065 | A * | 9/1977 | Walter | 175/52 |
| 4,098,333 | A * | 7/1978 | Wells et al. | 166/352 |
| 4,258,796 | A * | 3/1981 | Horning et al. | 175/52 |
| 4,445,579 | A * | 5/1984 | Bello | 175/52 |
| 4,455,116 | A * | 6/1984 | Lindstedt et al. | 414/22.66 |
| 4,708,563 | A * | 11/1987 | Van Den Berg et al. | 414/22.66 |
| 4,892,160 | A * | 1/1990 | Schivley et al. | 175/85 |
| 4,897,009 | A * | 1/1990 | Powell | 414/22.66 |
| 5,174,389 | A * | 12/1992 | Hansen | 175/52 |
| 5,244,329 | A * | 9/1993 | McGill et al. | 414/22.63 |
| 5,263,545 | A * | 11/1993 | Tudora et al. | 175/52 |
| 5,297,642 | A * | 3/1994 | Rajakallio et al. | 175/85 |
| 5,423,390 | A * | 6/1995 | Donnally et al. | 175/85 |
| 5,762,150 | A * | 6/1998 | Cheng et al. | 175/52 |
| 5,954,209 | A * | 9/1999 | Wurm et al. | 211/70.4 |
| 6,047,781 | A * | 4/2000 | Scott et al. | 175/5 |
| 6,085,852 | A * | 7/2000 | Sparks et al. | 175/52 |
| 6,089,333 | A * | 7/2000 | Rise | 175/85 |
| 6,244,360 | B1 * | 6/2001 | Steinsland | 175/52 |
| 6,298,927 | B1 * | 10/2001 | Back | 175/52 |
| 6,364,011 | B1 * | 4/2002 | Bergeron | 166/77.51 |
| 6,394,192 | B1 * | 5/2002 | Frazer | 175/58 |
| 6,457,526 | B1 * | 10/2002 | Dailey | 166/338 |
| 6,543,555 | B2 * | 4/2003 | Casagrande | 175/85 |
| 6,588,981 | B2 * | 7/2003 | Willis et al. | 405/168.1 |
| 6,601,649 | B2 * | 8/2003 | Beato et al. | 166/352 |
| 6,763,898 | B1 * | 7/2004 | Roodenburg et al. | 175/7 |
| 7,083,004 | B2 | 8/2006 | Roodenburg et al. | |
| 7,104,316 | B1 * | 9/2006 | Hobgood | 166/77.51 |
| 7,140,453 | B2 * | 11/2006 | Ayling | 175/52 |
| 7,540,338 | B2 * | 6/2009 | Belik | 175/57 |
| 7,600,570 | B2 * | 10/2009 | Haughom | 166/358 |
| 7,607,866 | B2 * | 10/2009 | Eddowes et al. | 405/259.1 |
| 7,735,580 | B2 * | 6/2010 | Kraus et al. | 175/52 |
| 7,779,916 | B2 * | 8/2010 | Zemlak et al. | 166/336 |
| 7,886,846 | B2 * | 2/2011 | Pires | 175/52 |
| 8,052,369 | B2 * | 11/2011 | Often et al. | 414/22.55 |
| 8,052,370 | B2 * | 11/2011 | Dekker et al. | 414/22.66 |
| 8,342,236 | B2 * | 1/2013 | Bienfang et al. | 166/77.51 |
| 8,425,171 | B2 * | 4/2013 | Mortensen et al. | 414/22.66 |
| 2002/0079137 | A1 * | 6/2002 | Mills et al. | 175/52 |
| 2002/0153169 | A1 * | 10/2002 | Sewell | 175/52 |
| 2002/0166698 | A1 * | 11/2002 | Beato et al. | 175/7 |
| 2005/0051072 | A1 * | 3/2005 | Roodenburg et al. | 114/201 R |
| 2006/0104747 | A1 * | 5/2006 | Zahn et al. | 414/22.63 |
| 2008/0164064 | A1 * | 7/2008 | Belik et al. | 175/52 |
| 2009/0136327 | A1 * | 5/2009 | Often et al. | 414/22.55 |
| 2009/0196712 | A1 * | 8/2009 | Mortensen et al. | 414/22.68 |
| 2010/0071958 | A1 * | 3/2010 | Bienfang et al. | 175/85 |
| 2010/0212915 | A1 * | 8/2010 | Heidecke et al. | 166/378 |
| 2010/0300697 | A1 * | 12/2010 | Wijning et al. | 166/352 |
| 2013/0284450 | A1 * | 10/2013 | Roodenburg et al. | 166/352 |
| 2014/0186143 | A1 * | 7/2014 | Owens | 414/22.66 |

* cited by examiner

TUBULARS STORAGE AND HANDLING SYSTEM

CROSS REFERENCE TO RELATED APPLICATIONS

This application is the National Phase of PCT/NL2010/000067 filed on Apr. 15, 2010, which claims the benefit under 35 U.S.C. 119(e) of U.S. Provisional Application No. 61/173,732 filed on Apr. 29, 2009, all of which are hereby expressly incorporated by reference into the present application.

The present invention relates to a hydrocarbon drilling tubulars storage and handling system.

In the oil and gas well drilling industry numerous types of piping, referred to generally as "tubulars", are used. Tubulars include for instance drill pipes, casing pipes, and other connectable (e.g. by screwthread) oil and gas well pipe elements.

Commonly multiple single joints of drill pipe or other tubular are held together during drilling operations, e.g. during tripping operations. Most modern drilling rigs are capable of handling three-joint stands, called "triples", or even quadruple stands, called "quads (135 ft)".

The present applicant has disclosed, e.g. in U.S. Pat. No. 7,083,004, a hydrocarbon drilling tubulars storage and handling system that includes two rotary storage racks, each rotary storage rack being rotatable about a vertical axis and having storage slots for storage of multiple tubulars in each rotary storage rack in vertical orientation, the first and second rotary storage rack each including a drive to rotate the storage rack about its vertical axis. In order to place a tubular in a rack and to remove a tubular from a rack, at least one tubular racker assembly associated with each of the rotary racks is provided. These known assemblies each include a vertical column member supporting multiple gripping members that allow to grip or engage on a tubular at different positions along its length. In the known assemblies the one or more gripping members are each fitted on an articulated arm having an associated drive to move the arm, so that the gripping member is movable within a reach of the assembly.

The rotary racks in the known system are employed as setbacks, e.g. for drill pipe stands. In practice this means that for some drilling operations, in particular during a tripping operation, transfer of multi-joint tubulars between the firing line and the setbacks is performed at a high frequency. Therefore any failure of the system, in particular of a tubular racker assembly, may cause undesirable delay of the operation.

The present invention aims to propose solutions that allow for increased operational reliability of the system, at least allowing to reduce delay in case of malfunction.

According to a first aspect of the invention a system is proposed, wherein provision is made for a tubulars racking device positioned between the first and second rotary storage racks, said racking device including a rotary structure that is rotatable about a vertical axis and a drive to rotate the rotary structure about said vertical axis, the rotary structure supporting at a first side thereof a first tubular racker assembly and at a second side thereof a second tubular racker assembly, each tubular racker assembly including one or more one gripping members adapted to grip a tubular, wherein in a first rotary position of the rotary structure the first tubular racker assembly is operable to place a tubular in and remove a tubular from the first rotary storage rack, and the second tubular racker assembly is operable to place a tubular in and remove a tubular from the second rotary storage rack, and wherein in a second rotary position of the rotary structure the first tubular racker assembly is operable to place a tubular in and remove a tubular from the second rotary storage rack, and the second tubular racker assembly is operable to place a tubular in and remove a tubular from the first rotary storage rack.

In case of failure of one of the tubular racker assemblies of the racking device, this system allows to rotate the rotary structure of the racking device so that the still functioning tubular racker assembly can be used in combination with each of the rotary racks of the system. This allows to reduce the impact of the malfunction on e.g. the tripping operation.

In a preferred embodiment the first and second tubular racker assembly include a first and second vertical column member respectively, said column members each supporting said one or more gripping members. Preferably said first and second vertical column members are mounted on a rotary structure with a space being present between said first and second vertical column members.

As drilling rig systems often also include storage of tubulars in horizontal position, e.g. in a hold and/or on deck of a drilling vessel, it is common to employ a so-called horizontal catwalk machine to assist in the transfer of tubulars, often to and from the firing line of the drilling rig system. As both this catwalk machine and the tubulars storage and handling system are preferably located in close vicinity to the firing line, it is considered an advantageous embodiment when the catwalk machine is arranged to move drilling tubulars through a space between the first and second vertical column members of the racking device. This allows for optimal use of available space, and also allows for efficient use of the system.

In a practical embodiment the rotary support of the column members includes a base member to which the column members are connected with their lower end and a top member to which the column members are connected with their upper end.

In view of the desire to obtain a reduction of any delays should a malfunction occur, in particular of a tubular racker assembly, it is preferred that the first and second tubular racker assembly are mounted in the rotary structure so as to be exchangeable, e.g. for maintenance, and that the system further includes a docking station and a third tubular racker assembly in said tubular racker assembly docking station, preferably next to the racking device, so as to allow for the replacement of one of the first and second tubular racker assembly by said third tubular racker assembly.

In a further preferred embodiment the system also includes a vacant tubular racker assembly docking station adapted to receive a tubular racker assembly therein, preferably next to the racking device. This allows to place the malfunctioning assembly in the vacant docking station first, and then to place the third or spare assembly in the rotary structure of the racking device.

In a preferred embodiment a tubular racking assembly docking station includes one or more work platforms for maintenance personnel, allowing access to the tubular racker assembly in the docking station, wherein possibly at least one work platform is movable at least in vertical direction, e.g. by an associated lifting device.

In a possible embodiment the system further comprises one or more stationary tubulars storage racks for storage of multiple tubulars in vertical orientation, said one or more stationary tubulars storage racks being arranged adjacent at least one of the first and second rotary storage racks. These stationary storage racks can e.g. be used to storage special tubulars, e.g. other than drill pipe stands or drill collars.

In a preferred embodiment said one or more stationary tubulars storage racks are arranged adjacent at least one of the first and second rotary storage racks such that at least one of the first and second tubulars racker assemblies is operable to place a tubular in and remove a tubular from said one or more stationary tubulars storage racks.

As mentioned above often provision is made for a horizontal catwalk machine, e.g. to feed drill pipes in horizontal position to a stand-building location adjacent the storage racks. It is preferred, as is common, to have the system furthermore comprising a horizontal to vertical tubular handling device allowing to receive a tubular in horizontal orientation from a catwalk machine and position the tubular in vertical orientation.

Depending on the layout of the drilling rig and the design of the tubulars storage and handling system, the tubular racker assemblies can be used to perform the transfer of a tubular between a storage rack of the system and the firing line without the use of any additional equipment. It is however also envisaged that additional pipe handling equipment is needed for this transfer. Possibly said additional equipment includes a tubular tilting device that is adapted to receive a tubular and allows for tilting of a tubular between a vertical position wherein a tubular can be transferred between a tubular racker assembly of the system and the tilting device and a tilted position wherein a tubular can be transferred between the tilting device and a further tubular handling device, e.g. a drawworks and/or a rotary top drive mounted in a drilling rig. Other additional equipment for this transfer can also be readily used in combination with the inventive system.

According to a second aspect of the invention a hydrocarbon drilling tubulars storage and handling system is provided, wherein a tubulars racking device includes a first tubular racker assembly and a second tubular racker assembly, each tubular racker assembly including one or more one gripping members adapted to grip a tubular, wherein the first tubular racker assembly is operable to place a tubular in and remove a tubular from the first rotary storage rack, and the second tubular racker assembly is operable to place a tubular in and remove a tubular from the second rotary storage rack, wherein the first and second tubular racker assembly include a first and second vertical column member respectively, said column members each supporting said one or more gripping members, and wherein the first and second tubular racker assembly are mounted so as to be exchangeable, e.g. for maintenance, and wherein the system further includes a tubular racker assembly docking station and a third tubular racker assembly in said tubular racking assembly docking station, preferably next to the racking device, so as to allow for replacement of one of the first and second tubular racker assembly by said third tubular racker assembly.

It will be appreciated that the provision of a dedicated tubular racker assembly docking station and a third or spare tubular racker assembly in said docking station allows to reduce any downtime or reduced operational capabilities of the system, by exchanging the malfunctioning assembly by the third assembly.

It will be appreciated that the inventive systems can be employed on an offshore drilling structure, such as a vessel, a jack-up vessel, an offshore platform, etc. Of course the system can also be employed for a land based drilling rig.

In U.S. Pat. No. 7,083,004 the present applicant has disclosed an offshore drilling vessel having:

a hull;

a drilling structure arranged on the hull, said drilling structure including equipment defining at least one firing line for performing drilling operations, wherein the drilling structure is a mast forming at least one firing line along and on the outside of the mast; and a hydrocarbon drilling tubulars storage and handling system.

It will be appreciated that the systems according to the first and second aspect of the invention can be employed in combination with such a drilling vessel.

In a preferred embodiment it is envisaged that a tubular racker assembly docking station is provided in the mast, e.g. as a vertical hold within the contour of the mast having a side access opening in the outer perimeter of the mast to allow transfer of the assembly.

It is observed that in the U.S. Pat. No. 7,083,004 offshore drilling vessel the rotary storage racks are placed above the main deck of the vessel. As the weight of the tubulars stored in the racks can be very significant, it is a possible embodiment to mount the rotary storage racks and associated racking device in an open topped hold in the hull such that a portion of the rotary storage racks and the racking device extends above the main deck. This is in particular favorable on a monohull drilling vessel.

When employed on a drilling vessel, in particular a monohull drilling vessel, having a longitudinal central axis it is preferred to arrange the rotary storage racks symmetrical with respect to said longitudinal central axis.

The invention will now be explained in more detail with reference to the appended drawing.

Figure 2:
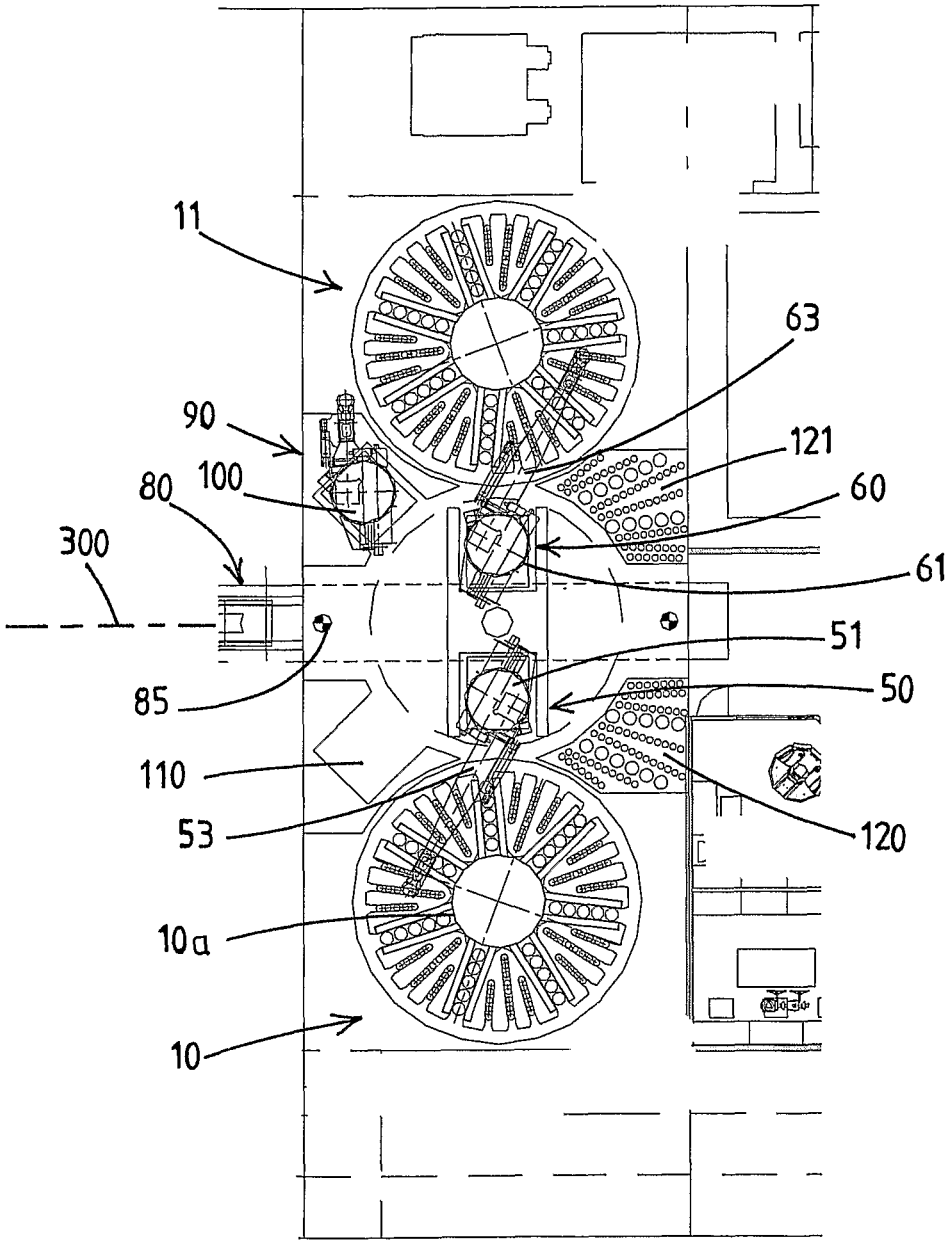
Figure 3:
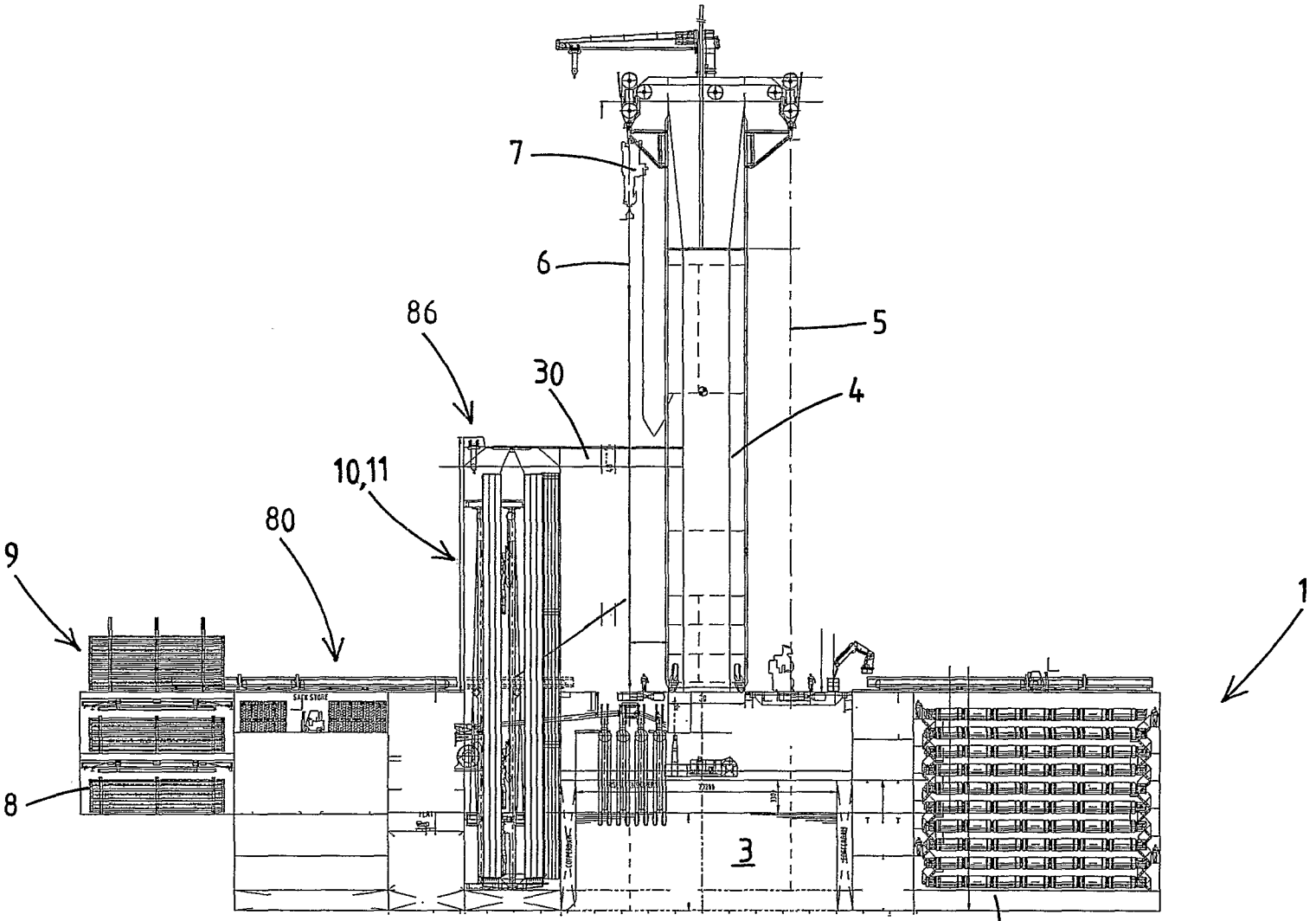
Figure 4:
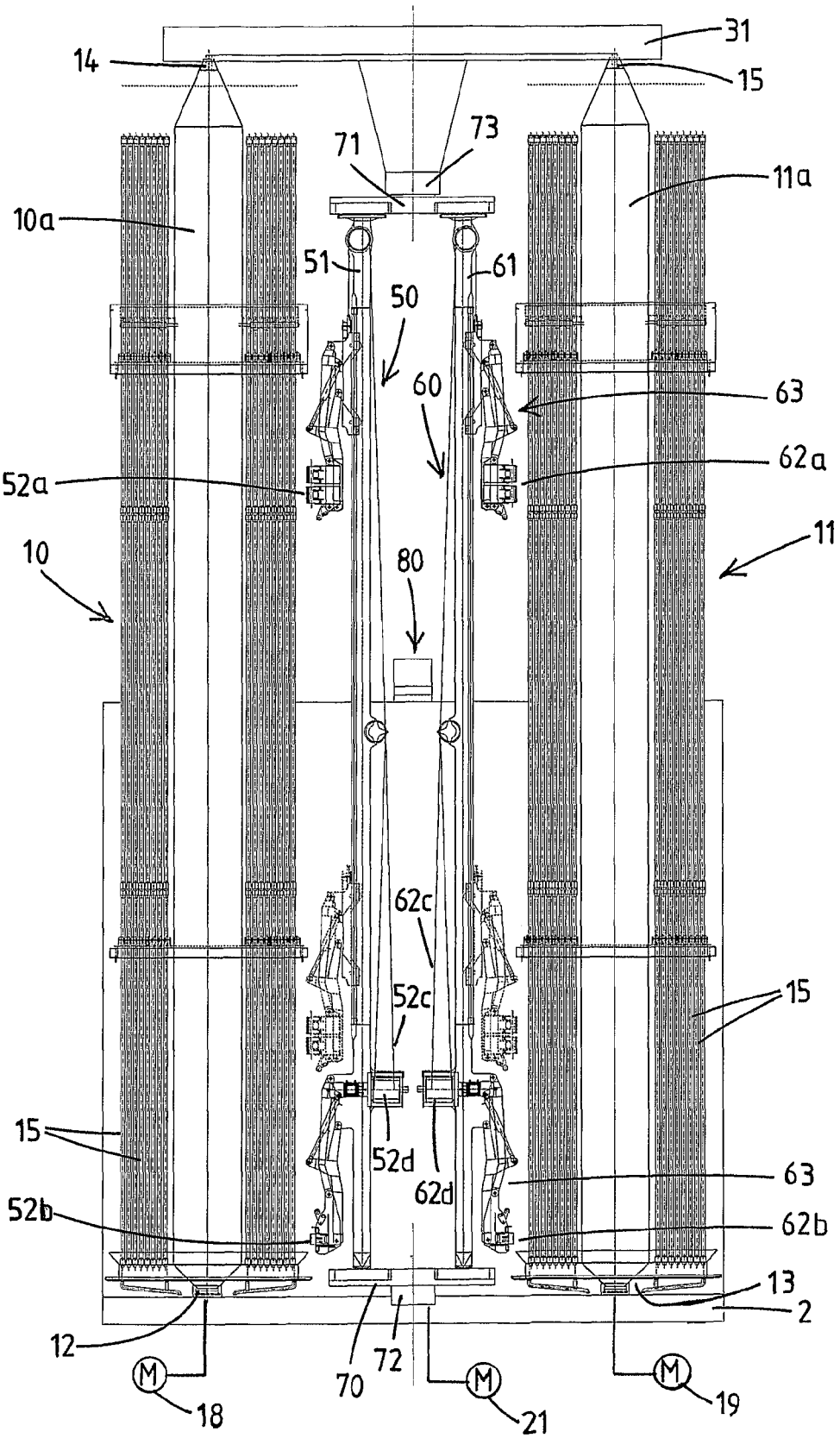

In the drawing:

FIG. 1 shows a plan view of a portion of the upper deck of a drilling vessel with a system according to the invention FIG. 2 shows on a larger scale a part of FIG. 1, FIG. 3 shows a section of a portion of the drilling vessel of FIG. 1, FIG. 4 shows schematically the racking device of the vessel of FIG. 1.

With reference to FIGS. 1-4 now an embodiment of a oil and gas offshore drilling vessel equipped with a drilling tubulars storage and handling system will be explained.

The vessel 1 here is a monohull vessel having a hull 2 with a moonpool 3 extending through the hull. A mast 4 is mounted on the hull, here above the moonpool. The mast is associated with hoisting means, in the art called drawworks, forming two firing lines 5, 6 along and on the outside of the mast, here fore and aft of the mast 4, that extend through the moonpool 3.

The firing line 6 is designed for performing drilling, and here includes a topdrive 7 or other rotary drive for rotary driving a drill string.

The vessel 1 is equipped with a drilling tubulars storage and handling system that includes two rotary storage racks 10, 11 for tubulars 15, and an associated racking device 20. In this example these items are mounted in an open topped hold in the hull 2 such that a portion of the rotary storage racks and the racking device extends above the main deck of the vessel.

As can be seen in FIGS. 1 and 2 the vessel has a longitudinal central axis 300, and the rotary storage racks 10, 11 are arranged symmetrical with respect to said longitudinal central axis 300.

Due to the placement of the storage racks in the hold, and aided by the symmetrical arrangement, the effect of the weight of the system and any tubulars placed therein on the vessels behavior is minimized.

As can be seen in FIG. 4 the tubulars storage and handling system here includes a first and second rotary storage rack 10, 11. Each rotary storage rack is rotatable mounted on the vessel so as to rotate about a vertical axis. As can be seen a lower bearing 12, 13 is present at the lower end of each rack, connecting the rack to the hull. Also, as is preferred, an upper bearing 14, 15 is present at the top end of the rack, connecting said top end to a support frame. Here the support frame includes members 30 that connect the top ends of the rotary racks to the mast, as well as a support frame member 31 that interconnects the top ends of the racks 10, 11.

As is known in the art each rotary storage rack 10, 11 includes slots for the storage of multiple tubulars in each rotary storage rack in vertical orientation. As is known in the art the racks 10, 11 here include a central vertical post 10*a*, 11*a*, and multiple disc members at different heights of the post, at least one of them provided with said storage slots (see FIGS. 1,2) and possibly also with operable latches as common in fingerboards. It is envisaged that in a preferred embodiment the tubulars rest with their lower end on a lowermost disc member 10*b*, 11*b*. In the example shown in the FIGS. 1-4 it is envisaged that triple stands are stored in the racks 10, 11. The diameter of each rack is about 8 meters.

Also schematically indicated are drive motors 18, 19 for each of the first and second rotary storage rack 10, 11 that allow to rotate the storage rack about its vertical axis. In a possible embodiment the drive motors 18, 19 are embodied as part of an indexing drive for the racks, so that each of the rack can be brought in a multitude of predetermined rotary positions.

As can be seen the system also includes a tubulars racking device 20 generally positioned near or between the first and second rotary storage racks 10, 11. This racking device includes a rotary structure that is rotatable about a vertical axis and a drive 21 to rotate the rotary structure about said vertical axis.

The rotary structure supports at a first side thereof a first tubular racker assembly 50 and at a second side thereof a second tubular racker assembly 60. These tubular racker assemblies 50, 60 preferably are of the same design, and each tubular racker assembly includes one or more movable gripping members 52*a*, 52*b*, 62*a*, 62*b* adapted to grip a tubular to be removed from a rotary storage rack or placed in said rack.

In this example, and as known from the prior art, the first and second tubular racker assembly 50, 60 each include a first and second vertical column member 51, 61 respectively, said column members 51, 61 each supporting said one or more gripping members. In this example each column member supports multiple, here two, gripping members 52*a*,52*b*,62*a*, 62*b*. In this example, and as is also known from the prior art, each gripping member is mounted on a motion device, here an articulated arm 53, 63, allowing to displace the gripping member within a reach outside of the column member.

Also in this example, and as also known from the prior art, some or all gripping members, here upper gripping members 52*a*, 62*a*, are vertically displaceable along the column member 51, 61, e.g. by an associated cable 52*c*,62*c* and winch 52*d*, 62*d*, in order to adjust the height position of the gripper members to the tubulars to be handled. The upper gripping members 52*a*,62*a* are shown with dashed lines in their lower position in FIG. 4.

As is also known from the prior art, a drive motor (not shown) is associated with each column member 51, 61 allowing to pivot the column member about its vertical axis, thereby also moving the grippers and any tubular held by said grippers.

As can be seen in FIG. 4 the first and second vertical column members 51, 61 are mounted on a rotary support with a space between said first and second vertical column members 51, 61.

In this example the rotary support of the column members 51, 61 includes a base member 70 to which the column members 51, 61 are connected with their lower end and a top member 71 to which the column members are connected with their upper end.

Here the base member 70 is supported via a bearing 72 on the hull and the top member 71 is supported by a bearing 73 from the frame member 31.

In general the rotary structure is formed here by the base member 70 and top member 71, and is rotatable about a vertical axis. A drive motor 21, here engaging on the base member 70, is provided to perform said motion. A synchronized drive motor may act on the top member or top end of the rotary structure to avoid excessive torsional loads on the rotary structure.

The system is such that in a first rotary position of the rotary structure (see FIGS. 1, 2) the first tubular racker assembly 50 is operable to place a tubular in and remove a tubular from the first rotary storage rack 10, and the second tubular racker assembly 60 is operable to place a tubular in and remove a tubular from the second rotary storage rack 11. By suitable activation of the drive motor 21 the rotary structure can be brought in at least a second rotary position, wherein the first tubular racker assembly 50 is operable to place a tubulars in and remove a tubular from the second rotary storage rack 11, and wherein the second tubular racker assembly 60 is operable to place a tubular in and remove a tubular from the first rotary storage rack 10. As explained in case of failure of one of the assemblies 50, 60 this rotary design of the racker device allows to use the still functioning assembly in combination with both rotary storage racks.

The vessel 1 also includes a horizontal catwalk machine 80 on the deck and aligned with the relevant firing line and allowing to bring tubulars from a remote position towards the firing line or to a stand-building location 85 next to the racks 10, 11, e.g. from hold 8 for horizontal storage of drilling tubulars in the aft portion of the hull and/or the deck storage 9. A crane 17 is provided to place tubulars on the catwalk machine 80 and remove them there from.

As is preferred the catwalk machine 80 is arranged on the central longitudinal axis of the vessel on the deck. As the rotary racks 10, 11 are also placed on the same side of the firing line as the cat walk machine it is considered advantageous that the column members 51, 61 are spaced from one another such that the catwalk machine 80 is able to move tubulars through the space between the first and second vertical column members 51, 61 of the racking device, as is preferred in a rotary position of the racking device wherein full operation thereof is possible. This allows to use to catwalk machine 80 and the inventive system substantially at the same time or at least overlapping in time.

The connection of the column members 51, 61 to the rotary structure, here the base member 70 and the upper member 71, preferably is formed by detachable connectors (not shown, e.g. bolts, pins, hydraulic latches, etc.) allowing to readily disconnect a column member from said rotary structure. This allows to exchange each of the first and second tubular racker assembly 50, 60, e.g. for maintenance or repairs.

As is preferred the vessel includes a docking station 90 and a third tubular racker assembly 100 in said docking station 90. The third tubular racker assembly 100 is of the same design as the assemblies 50, 60 or at least has a similarity that allows to replace each of the assemblies 50, 60 by said assembly 100.

As is preferred said docking station 90 is adapted to store the assembly 100 in upright position, and the station may contain operable holding devices to hold the assembly and release the assembly 100 on command.

The docking station 90 is arranged directly adjacent the racking device, and is here formed by a hold in the hull having a side access opening into the hold for the racks 10, 11 and the racking device.

It is envisaged that the docking station includes a docking station structure extending above the deck of the vessel, preferably to the top of the assembly 100 to be received in the docking station. For instance a docking station includes a staircase or elevator extending over the height of the docking station.

As can be seen in this example also a second, preferably vacant, tubular racker assembly docking station 110 is provided adjacent the hold for the racks 10, 11 and the racking device, said docking station preferably of the same design as the docking station 90 and adapted to receive a tubular racker assembly therein. In case of a malfunctioning assembly in the racking device 20, this assembly can be released from the racking device and placed in the vacant docking station 110. Then the rotary structure of the racking device can be rotated to align the now empty spot for the assembly with the docking station 90. Then the tubular racker assembly stored in said docking station 90 can be transferred to the rotary structure of the racking device and secured therein, so that the racking device is fully operational again. Meanwhile repairs can be carried out in the docking station 110 on the malfunctioning assembly. Obviously the same routine can be performed should another exchange be required.

As is preferred each docking station 90, 110 includes one or more work platforms for maintenance personnel allowing access to the tubular gripping arrangement in the docking station. Possibly one or more work platforms are movable at least in vertical direction, e.g. by an associated lifting device.

In the example shown here the tubulars storage and handling system further comprises one or more stationary tubulars storage racks 120, 121 for storage of multiple tubulars in vertical orientation. These stationary tubulars storage racks 120, 121 are arranged adjacent the first and second rotary storage racks.

In a possible embodiment the one or more stationary tubulars storage racks are arranged adjacent at least one of the first and second rotary storage racks such that at least one of the first and second tubulars racker assemblies 50, 60 is operable to place a tubular in and remove a tubular from said one or more stationary tubulars storage racks.

Whilst not shown in the drawings it is possible that the system furthermore comprises a horizontal-to-vertical tubular handling device allowing to receive a tubular in horizontal orientation from the catwalk machine 80 and position the tubular in vertical orientation, e.g. for stand building. These devices are known in the art. One can envisage that a crane 86 with hoist block, cable and winch operable at the standbuilding location 85 is used for this purpose. As an alternative a swinging loader boom can be fitted to the mast, to engage with the top end of a tubular that is removed from the rack 10, 11 and then operated to both raise the tubular from the hold 8 and bring it in the firing line. In another alternative a horizontally travelling cart is provided that engages on a tubular at an upper portion thereof. The cart is then movable to the firing line, so that the tubular can be connected to the drawworks at said firing line, and the tubular is then raised so as to extent in the firing line in a rather conventional manner.

In the vessel shown here, the tubulars are stored in the racks at a significant lower level than the deck at the aft firing line 6. Therefore a vertical transport of the tubular removed from a rack 10, 11 by an assembly 50, 60 is required. It is envisaged that in a possible embodiment the assemblies 50, 60 include themselves a lifting device to effect this motion.

As an alternative it can be envisaged to perform this transfer with the aid of other known equipment such as a tubular tilting device that is adapted to receive a tubular and allows for tilting of a tubular between a vertical position wherein a tubular can be transferred between a tubular racker assembly of the system and the tilting device and a tilted position wherein a tubular can be transferred between the tubular racker assembly of the system and a further tubular handling device, e.g. the top drive.

It will be appreciated that the provision of one or more docking stations 90, 110 and at least a further tubular racker assembly stored in a docking station for replacement of a malfunctioning assembly allows to reduce any downtime or reduced operational capability of the system. It will be appreciated that this may also be incorporated in a drilling vessel having a hull and a drilling structure arranged on the hull, said drilling structure including equipment defining at least one firing line for performing drilling operations, wherein the drilling structure is a mast forming at least one firing line along and on the outside of the mast. In particular when one or more tubular racker assemblies are supported by the mast, e.g. at one or more corners of a rectangular cross-section mast as is known in the art, it is envisaged that a tubular racker assembly docking station is provided in the mast, e.g. as a vertical hold within the contour of the mast having a side access opening to allow transfer of the assembly.

Standbuilding can for example be performed using catwalk machine 80, crane 86 and one of the tubulars racker assemblies 50, 60. For instance a standbuilding machine, e.g. including a hang-off clamp and an iron-roughneck are present at the location 85. For instance single lengths of tubular are supplied by means of machine 80, then hoisted by crane 86 and assembled with the standbuilding machine. For instance a multiple length joint of tubulars is held by the gripping members of an assembly 50 or 60 at a position remote from the stand-building line so as to allow a further, e.g. two joint stand portion to be assembled. This stand portion is then held in raised position, whereas the other pre-assembled stand portion is then maneuvered underneath and the two stand portions are interconnected to form the complete stand, e.g. a quad stand. The stand can then be placed in a rack using one of the assemblies 50,60.

The docking stations 90, 110 can be arranged next to one another, e.g. to simplify the structure of the system.

The invention claimed is:

1. A hydrocarbon drilling tubulars storage and handling system, said system comprising:

first and second rotary storage racks, each rotary storage rack being rotatable about a vertical axis and having storage slots for storage of multiple tubulars in each rotary storage rack in vertical orientation, the first and second rotary storage rack each including a drive to rotate the storage rack about the vertical axis of the storage rack, a tubulars racking device positioned between the first and second rotary storage racks, said racking device including a rotary structure that is rotatable about a vertical axis of the rotary structure, the rotary structure supporting at a first side thereof a first tubular racker assembly and at a second side thereof a second tubular racker assembly, each tubular racker assembly including one or more gripping members adapted to grip a tubular, and a drive to rotate the rotary structure about said vertical axis of the rotary structure thereby simultaneously rotating the first tubular racker assembly and the second tubular racker assembly about said vertical axis of the rotary structure, wherein in a first rotary position of the rotary structure the first tubular racker assembly is operable to place a tubular in and remove a tubular from the first rotary storage rack, and the second tubular racker assembly is operable to place a tubular in and remove a tubular from the second rotary storage rack, and wherein in a second rotary position of the rotary structure the first tubular racker assembly is operable to place a tubular in and remove a tubular from the second rotary storage rack, and the second tubular racker assembly is operable to place a tubular in and remove a tubular from the first rotary storage rack.

2. The system according to claim 1, wherein the first and second tubular racker assembly include a first and second vertical column member respectively, said column members each supporting said one or more gripping members, and wherein said first and second vertical column members are mounted on a rotary support with a space between said first and second vertical column members.

3. The system according to claim 2, wherein the system further includes a horizontal catwalk machine arranged to move drilling tubulars through the space between the first and second vertical column members of the racking device.

4. The system according to claim 2, wherein the rotary support of the column members includes a base member to which each column member is fixed with a lower end of the respective column member and a top member to which each column member is fixed with an upper end of the respective column member.

5. The system according to claim 1, wherein the first and second tubular racker assembly are mounted in the rotary structure so as to be exchangeable, and wherein the system further includes a docking station and a third tubular racker assembly in said docking station, preferably next to the racking device, so as to allow for replacement of one of the first and second tubular racker assembly by said third tubular racker assembly.

6. The system according to claim 5, wherein the system further includes a vacant tubular racker assembly docking station adapted to receive a tubular racker assembly therein, preferably next to the racking device.

7. The system according to claim 5, wherein the docking station includes one or more work platforms for maintenance personnel, allowing access to the first second or third tubular racker assembly in the docking station, wherein possibly one or more work platforms are movable at least in vertical direction.

8. The system according to claim 1, wherein the system further comprises one or more stationary tubulars storage racks for storage of multiple tubulars in vertical orientation, said one or more stationary tubulars storage racks be arranged adjacent at least one of the first and second rotary storage racks.

9. The system according to claim 8, wherein said one or more stationary tubulars storage racks are arranged adjacent at least one of the first and second rotary storage racks such that at least one of the first and second tubulars racker assemblies is operable to place a tubular in and remove a tubular from said one or more stationary tubulars storage racks.

10. The system according to claim 1, wherein the system furthermore comprises a horizontal to vertical tubular handling device allowing to receive a tubular in horizontal orientation from the catwalk machine and position the tubular in vertical orientation.

11. The system according to claim 1, wherein the system further includes a tubular tilting device that is adapted to receive a tubular and allows for tilting of a tubular between a vertical position wherein a tubular can be transferred between the first or second tubular racker assembly of the system and the tilting device and a tilted position wherein a tubular can be transferred between the first or second tubular racker assembly of the system and a further tubular handling device.

12. An offshore drilling vessel comprising:

a hull;

a drilling structure arranged on the hull, said drilling structure including equipment defining at least one firing line for performing drilling operations, a hydrocarbon drilling tubulars storage and handling system according to claim 1.

13. The offshore drilling vessel according to claim 12, wherein the hull has a main deck, and wherein the rotary storage racks and associated racking device are mounted in an open topped hold in said hull such that a portion of the rotary storage racks and the racking device extends above the main deck.

14. The offshore drilling vessel according to claim 12, wherein the vessel has a longitudinal central axis, and wherein the rotary storage racks are arranged symmetrical with respect to said longitudinal central axis.

15. The offshore drilling vessel according to claim 12, wherein a moonpool is present in the hull, and wherein the drilling structure is a mast at or near the moonpool forming at least one firing line along and on the outside of the mast.

16. The offshore drilling vessel according to claim 15, provided with a hydrocarbon drilling tubulars storage and handling system, said system comprising:

first and second rotary storage racks, each rotary storage rack being rotatable about a vertical axis and having storage slots for storage of multiple tubulars in each rotary storage rack in vertical orientation, the first and second rotary storage rack each including a drive to rotate the storage rack about the vertical axis of the storage rack, a tubulars racking device including a first tubular racker assembly and a second tubular racker assembly, each tubular racker assembly including one or more gripping members adapted to grip a tubular, wherein the first tubular racker assembly is operable to place a tubular in and remove a tubular from the first rotary storage rack, and the second tubular racker assembly is operable to place a tubular in and remove a tubular from the second rotary storage rack, wherein the first and second tubular racker assembly include a first and second vertical column member respectively, said column members each supporting said one or more gripping members, and wherein the first and second tubular racker assembly are mounted so as to be exchangeable, and wherein the system further includes a tubular racker assembly docking station and a third tubular racker assembly in said docking station, preferably next to the racking device, so as to allow for replacement of one of the first and second tubular racker assembly by said third tubular racker assembly, wherein the first and second tubular racker assemblies are supported by the mast, and wherein the tubular racker assembly docking station is provided in the mast.

17. The system according to claim 2, wherein the first and second tubular racker assembly are mounted in the rotary structure so as to be exchangeable, and wherein the system further includes a docking station and a third tubular racker assembly in said docking station, preferably next to the racking device, so as to allow for replacement of one of the first and second tubular racker assembly by said third tubular racker assembly.

* * * * *